US006146690A

United States Patent [19]

Kustermann

[11] Patent Number: 6,146,690

[45] Date of Patent: Nov. 14, 2000

[54] COATING DEVICE AND COATING METHOD

[75] Inventor: Martin Kustermann, Heidenheim, Germany

[73] Assignee: Voith Sulzer Papiertechnik Patent GmbH, Heidenheim, Germany

[21] Appl. No.: 09/345,467

[22] Filed: Jun. 30, 1999

[30] Foreign Application Priority Data

Jul. 1, 1998 [DE] Germany ..... 198 29 449

[51] Int. Cl.[7] ..... B05D 1/30; B05C 5/00

[52] U.S. Cl. ..... 427/8; 427/420; 427/294; 427/296; 118/712; 118/50; 118/324; 118/DIG. 4

[58] Field of Search ..... 427/420, 294, 427/296, 8; 118/324, DIG. 4, 712, 50

[56] References Cited

U.S. PATENT DOCUMENTS

| | | | |
|---|---|---|---|
| 5,206,057 | 4/1993 | Finnicum et al. | 427/420 |
| 5,224,996 | 7/1993 | Ghys et al. | 118/325 |
| 5,624,715 | 4/1997 | Gueggi et al. | 427/420 |

FOREIGN PATENT DOCUMENTS

| | | |
|---|---|---|
| 0 517 223 B1 | 9/1996 | European Pat. Off. . |
| 0 858 842 A2 | 8/1998 | European Pat. Off. . |
| 3338095 A1 | 5/1985 | Germany . |
| 3424884 C1 | 2/1986 | Germany . |
| 0 517 223 T1 | 12/1993 | Germany . |
| 297 11 713 U1 | 10/1997 | Germany . |
| WO 98/05435 | 2/1998 | WIPO . |

*Primary Examiner*—Katherine A. Bareford
*Attorney, Agent, or Firm*—Taylor & Aust, P.C.

[57] ABSTRACT

A device for the application of a liquid or viscous coating medium onto a moving material web, specifically a paper or cardboard web, includes a curtain coater to apply the coating medium in the form of a curtain or veil to the material web and a suction device to remove air which is carried along by the material web and/or the veil of coating medium. A dynamic pressure analyzer determines the pressure of the air that accumulates before the line of contact of the curtain of coating medium with the moving material web, when viewed in the direction of travel of the moving material web. A control unit controls the suction power of the suction device relative to the determined dynamic pressure.

28 Claims, 1 Drawing Sheet

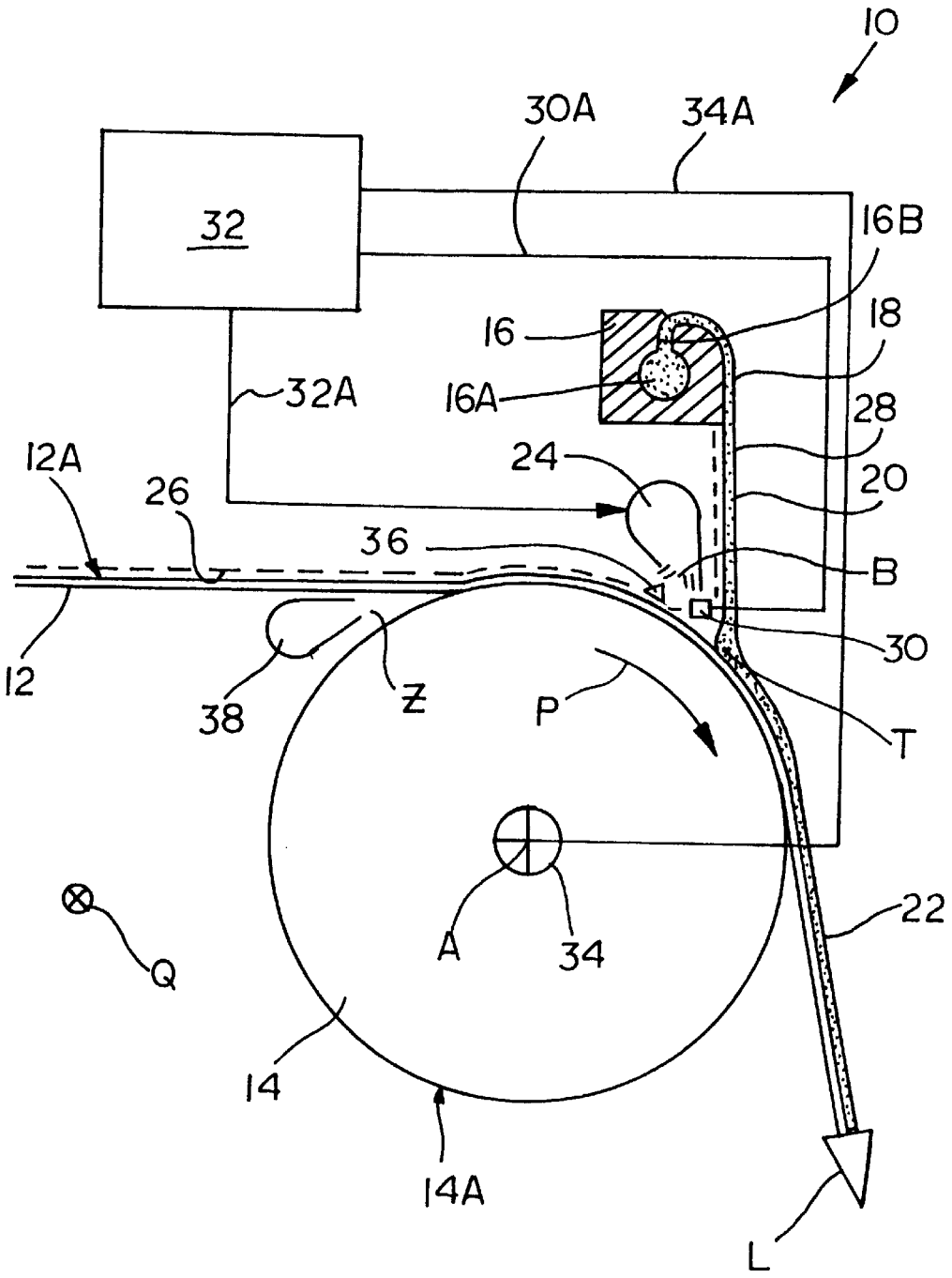
10
30A
34A
32
16B
16
18
16A
32A
28
12A
24
20
26
36
B
12
30
38
Z
P
T
22
A
34
Q
14
14A
L

COATING DEVICE AND COATING METHOD

BACKGROUND OF THE INVENTION

1. Field of the Invention

The present invention relates to a device for the application of a liquid or viscous coating medium onto a moving surface.

2. Description of the Related Art

Devices for applying coating medium onto a moving surface typically utilize a veil applicator unit/curtain coater which applies the coating medium in the form of a veil or curtain to the moving surface. In the instance of direct application, the moving surface is the surface of a material web, specifically a paper or carton web. In the instance of indirect application, the moving surface is a transfer element which then transfers the coating medium to the material web. A suction device is typically provided for suction removal of air which is carried along by the moving surface and/or the curtain. When coating a moving surface by use of a veil applicator unit, also referred to as the "curtain coating" method, the liquid or viscous coating medium is released by the curtain coater at a predetermined height above the moving surface and drops in the form of a veil or curtain onto the moving surface. Such a coating medium curtain is a relatively unstable formation. Therefore, great care must be exercised to ensure that the conditions under which the coating medium curtain makes contact with the moving surface are such that a high quality coating results. In particular, interruption of the coating medium curtain must be prevented, since this would result in especially strong formation of coating medium splashes. Control of the air boundary layer which is carried along by the moving surface into the area of contact is of central importance. Even if the air boundary layer does not penetrate or interrupt the coating medium curtain, it could prevent uniform coverage of the moving surface with coating medium through formation of air bubbles between the moving surface and the coating medium.

In German patent document 297 11 713, the provision of a blast nozzle disposed prior to the line of impact of the coating medium on the moving surface, when viewed in the direction of travel of the moving surface, is described. The blast nozzle emits an air jet in a direction opposite to the direction of travel of the moving surface. This air jet "cuts" into the air boundary layer, thereby lifting it from the moving surface. Of course, the coating medium curtain is impaired by the turbulence created as a result of the interaction between the air boundary layer and the air jet. The coating medium, therefore, had to be applied in great excess to the moving surface in order to provide a sufficiently stable coating medium curtain.

Under the terms of U.S. Pat. No. 5,624,715, the intrusion of the air boundary layer into the application area is made more difficult by use of a blade which is located a short distance from the moving surface. The blade is followed by a suction device that removes from the application area the remaining air that is being carried along by the moving surface and the air that is being carried along by the coating medium curtain. However, the coating medium curtain may now be impaired not only by an excessively high pressure caused by the boundary air layer, but also by an excessively low pressure caused by the suction device. When utilizing the applicator unit which is described in U.S. Pat. No. 5,624,715, it is necessary to apply the coating medium in great excess onto the moving surface and then scrape off the excess coating medium in order to ensure, respectively, an appropriately stable coating medium curtain and a high-quality coating result. This method requires appropriately dimensioned, large diameter supply and return lines in the area of the curtain coater, as well as in the area of the doctoring device, and appropriately efficient and powerful feed pumps for supplying the excess of coating medium.

A method for the treatment of the coating medium is described in European Patent document 0 517 223 B1, according to which air bubbles are removed from the coating medium in order to achieve a high-quality coating result.

SUMMARY OF THE INVENTION

The present invention provides a coating device that utilizes a veil applicator unit/curtain coater in which the circulating volume of coating medium, the diameters of the return lines, and the power of the feed pumps for the coating mediums are reduced.

The present invention, utilizes an applicator unit including a dynamic pressure analyzer for specifying the pressure of the air that accumulates before the line of contact of the coating medium curtain with the moving surface, when viewed in the direction of travel of the moving surface, and a control unit to control the suction power of the suction unit dependent upon the dynamic pressure that is determined by the dynamic pressure analyzer. The pressure in the coating area is adjusted to a value favorable to providing a high quality coating result irrespective of the running speed of the moving surface, the dropping velocity of the coating medium, and similar parameters by controlling the suction power of the suction device in direct relation to the result specified by the dynamic pressure analyzer.

The dynamic pressure prevailing in the direction of travel of the moving surface is directly measured at a point prior to the line of impact of the coating medium curtain by use of at least one pressure sensor. Since the suction device must be located before the area of contact, and since the operation of the pressure sensor may be impaired by coating medium splashes, the dynamic pressure can also be determined indirectly by, for example, a speed sensor which measures the travel speed of the moving surface. The dynamic pressure that exists prior to the line of impact stems mainly from the air boundary layer that is being carried along by the moving surface, and partially from the air boundary layer that is being carried along by the coating medium curtain. The dropping velocity of the coating medium curtain is typically at a predetermined ratio relative to the traveling speed of the moving surface in order to prevent splashing when the coating medium makes contact with the moving surface. It must be noted that an indirect determination of the dynamic pressure may be used rather than a direct determination of dynamic pressure.

In further development of the invention, it is suggested that the coating medium exhibit a solids content of between approximately 5% and approximately 80%, preferably between approximately 30% and approximately 75%. In addition, the coating medium may contain at least one inorganic or organic pigment and at least one synthetic or natural binding agent.

The applicator unit of the present invention achieves a coating weight per application of between approximately 2 $g/m^2$ and approximately 40 $g/m^2$, preferably between approximately 3 $g/m^2$ and approximately 30 $g/m^2$. As used herein, the term "per application" indicates that several applicator units can be provided in accordance with the present invention for applying multiple coatings to the material web.

The applicator device of the present invention reduces the circulating volume of coating medium, and thereby the output of the feed pumps. It also increases the running speed of the moving surface, or material web, to more than 600 m/min., preferably more than 1000 m/min. In addition, the width of the material web to be coated may be wider than 2.5 m, preferably wider than 4.0 m.

In order to improve the coating result, it is further suggested that at least one scraper bar for removal of the air that is being carried along by the moving surface be located before the line of impact, when viewed in direction of travel of the moving surface. This scraper bar lifts the carried along air boundary layer from the surface and turns it in the direction toward the suction device. In this embodiment, the suction device no longer has to supply the suction power necessary for lifting the air boundary layer, and can therefore be constructed with correspondingly lower power. However, such a scraper bar does represent a wear and tear component which must be replaced from time to time. It will, therefore, depend on the individual application and boundary conditions whether an applicator device in accordance with the present invention be configured with such a scraper and, therefore, a correspondingly lower power suction device, or be configured without such a scraper and, therefore, with a correspondingly higher-performance suction device.

In the direct coating method, a device for stabilizing the material web travel is suggested. For example, an additional suction device producing a partial vacuum on the side of the material web that is facing away from the curtain coater and pulling the material web against a support element, such as a backing roll, serves as such a stabilizing device.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, which is a schematic, side view of an embodiment of an applicator device of the present invention.

The exemplification set out herein illustrates one preferred embodiment of the invention, in one form, and such exemplification is not to be construed as limiting the scope of the invention in any manner.

DETAILED DESCRIPTION OF THE INVENTION

Referring now to the drawing, there is shown an embodiment of an applicator device 10 of the present invention.

A material web 12 traveling in direction L runs around a backing roll 14 which rotates around a shaft A in the direction of arrow P. A curtain coater 16 has a distributer channel 16*a* from which liquid or viscous coating medium 18 is dispensed through outlet aperture 16*b*. Coating medium 18, thus dispensed, free-falls in the form of a coating medium veil or curtain 20, to the surface 12*a* of material web 12. The coating layer 22 created in this manner is smoothed, or excess coating medium is removed, by a metering and/or leveling device (not shown).

In order to ensure that the coating medium 18 is dispensed as uniformly as possible in cross direction Q, relative to material web 12, it is necessary that coating medium 18 at outlet aperture 16*b* is under substantially the same pressure across the entire length of distributor channel 16*a*. In order to achieve this, the coating medium is supplied in great excess through a supply line (not shown) to an inlet end of distribution channel 16*a*. Coating medium 18 that was not dispensed through the outlet aperture 16*b* is removed from distribution channel 16*a* at an outlet end thereof, and recycled into a coating medium reservoir. The coating medium that is removed by the metering and/or leveling device may also be collected and fed into the coating medium reservoir for reuse. In order to keep the circulating volume of coating medium 18 low and to be able to utilize lower performance, lower throughput feed pumps, a distribution channel 16*a* having an outlet cross section that decreases, or tapers, from inlet end to outlet end is utilized.

Another embodiment of applicator device 10 reduces the circulating volume of coating medium 18. In this embodiment, when viewed in the direction of travel L, or line T running in cross direction Q, prior to the location where the coating medium curtain 20 makes contact with the material web surface 12*a,* a suction device 24 is located in applicator device 10 and extends substantially across the entire width of the material web 12, in cross direction Q. The suction device 24 serves to suction remove air boundary layer 26 being carried along on surface 12*a* of material web 12 in flow direction L and/or to suction remove air which is being carried along on the surface of coating medium curtain 20 as air boundary layer 28 into area B before location T where the coating medium 18 makes contact with the material web surface 12*a,* and which at this location causes an increased dynamic pressure relative to the normal air pressure.

At least one pressure sensor 30 is disposed in area B. Pressure sensor 30 measures the dynamic pressure in area B and transmits a corresponding signal via signal line 30*a* to control unit 32. Additionally, speed sensor 34 is disposed at shaft A of backing roll 14 and transmits a measure signal to control unit 32 via signal line 34*a*. The pressure sensor 30 directly or indirectly measures the dynamic pressure in area B. In the embodiment shown, the dynamic pressure in area B may only be determined indirectly from the speed signal provided to control unit 32 by speed sensor 34. In this context it is understood that, for the purpose of this indirect determination of the dynamic pressure, further operating parameters must be known; for example, the diameter of backing roll 14, the condition—especially roughness—of the material web surface 12*a,* the composition and viscosity of the coating medium 18, and similar parameters which influence the ability of the material web 12 and the coating medium curtain 20 to carry along air. The indirect determination of the dynamic pressure in area B has the advantage that suction removal of air from area B is not hampered by the pressure sensors 30 and their signal lines 30*a*.

The control unit 32 determines the dynamic pressure prevailing in area B through signals that are transmitted to it via lines 30*a* and 34*a*. Control unit 32 compares the actual dynamic pressure value with a predetermined desired dynamic pressure value which may, for example, be stored in a data memory of control unit 32. In the event that there is a deviation of the actual dynamic pressure value from the desired dynamic pressure value, the control unit will determine whether the power of the suction device 24 is to be increased or decreased and will accordingly transmit a control signal to the suction device 24 via signal line 32*a*.

It must be noted that several pressure sensors 30 may be provided which may be positioned across the width of material web 12 where they would measure the prevailing dynamic pressure in each of their assigned sectors. The control unit 32 can then further process this local resolution information in various forms. For example, when determining the control signal for the suction device 24 this local resolution information can be utilized as the actual value for the dynamic pressure. It is also possible to control the performance of suction device 24 depending on the current maximum value of the local resolution information. Even if suction device 24 is divided into several sections whose suction performance can be individually controlled, the local resolution information can be utilized for a local resolution control of the suction performance.

In order to be able to easily lift the air boundary layer 26 from the surface 12*a* of material web 12, and to carry it to the suction device 24, a scraper bar 36 is provided on the material web surface 12*a* in the application area B. The scraper bar 36 is located either at a very short distance from the material web 12*a* or is positioned against it like a blade. Bar 36 strips the air that is carried along in air boundary layer 26 from the material web surface 12*a* and directs it to the suction opening of the suction device 24. Since the greater part of the air carried along by the boundary layer 26 is lifted mechanically from the surface 12*a,* the suction device 24 is constructed having a correspondingly lower power.

In order to be able to prevent fluttering of the material web in the application area B, an additional suction device 38 is located at the infeed position Z that is formed by the backing roll 14 and the material web 12. Suction device 38 maintains a partial vacuum in the infeed position Z, which pulls the material web 12 against the surface 14*a* of backing roll 14 so that material web 12 is laying substantially perfectly flat against backing roll 14. Thereby, the additional suction device 38 also contributes to a high quality coating result.

Applicator device 10 accomplishes a reduction of the circulating volume of coating medium 18 without resulting in a reduction in the coating quality. The lower circulating volume, the line cross section of the supply and discharge lines of the distributor chamber 16*a* of the curtain coater 16 and the return line (if present) of the leveling and/or metering device are reduced in size. In certain circumstances a discharge line may be totally eliminated. At the same time, the running speed and the width of the material web are increased, thereby resulting in an increase of productivity. Thus, the operating costs are reduced by minimizing wear and tear parts and by utilizing lower performance, lower throughput pumps. Material webs coated with the applicator device 10 in accordance with the present invention distinguish themselves through a high degree of coating uniformity and good coverage of the material web surface with coating medium, approaching air knife quality.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator device for the application of a coating medium onto a moving fiber material web, the moving fiber material web having a direction of travel and a coating surface, the coating surface carrying a first air boundary layer, said applicator device comprising:

a first applicator unit configured to discharge a veil of coating medium onto the coating surface of the material web at a line of contact, the veil of coating medium carrying a second air boundary layer;

at least one suction device having a suction power, said at least one suction device being configured for at least partially removing by suction at least one of said first air boundary layer and said second air boundary layer, said at least one suction device being disposed prior to said line of contact relative to the direction of travel of the material web;

a dynamic pressure analyzer configured for measuring a dynamic air pressure at a point prior to said line of contact relative to the direction of travel of the material web, said dynamic pressure analyzer providing a pressure signal indicative of said dynamic air pressure; and a control unit electrically coupled to said dynamic pressure analyzer, said control unit being configured for receiving said pressure signal and controlling said suction power of said at least one suction device dependent at least in part upon said pressure signal.

2. The applicator device of claim 1, wherein said dynamic pressure analyzer comprises at least one pressure sensor disposed prior to said line of contact relative to the direction of travel of the material web, said at least one pressure sensor being configured for directly measuring said dynamic air pressure.

3. The applicator device of claim 1, wherein said dynamic pressure analyzer comprises at least one speed sensor configured for measuring a travel speed of the material web.

4. The applicator device of claim 1, wherein the coating medium has a solids content approximately between 5% and 80%.

5. The applicator device of claim 4, wherein said solids content is approximately between 30% and 75%.

6. The applicator device of claim 1, wherein the coating medium contains at least one of an inorganic and organic pigment and at least one of a synthetic and natural binding agent.

7. The applicator device of claim 1, wherein said applicator device is configured to apply a predetermined coating weight of the coating medium onto the material web, said coating weight being approximately between 2 $g/m^2$ and 40 $g/m^2$.

8. The applicator device of claim 7, wherein said coating weight is approximately between 3 $g/m^2$ and 30 $g/m^2$.

9. The applicator device of claim 1, wherein the material web has a running speed greater than 600 m/min.

10. The applicator device of claim 9, wherein said running speed is greater than 1,000 m/min.

11. The applicator device of claim 1, wherein the moving fiber material web has a coating with configured to be coated with the coating medium, the coating width being greater than 2.5 m.

12. The applicator device of claim 11, wherein the coating width is greater than 4.0 m.

13. The applicator device of claim 1, further comprising at least one scraper bar disposed prior to said line of contact relative to the direction of travel of the material web, said at least one scraper bar configured for removing at least a portion of said first air boundary layer being carried by the coating surface of the moving fiber material web.

14. The applicator device of claim 1, further comprising:

a backing element configured to support a backing surface of the material web, the backing surface being opposite the coating surface; and a vacuum device configured to produce a partial vacuum between said backing element and the backing surface of the material web.

15. A method for the application of a coating medium onto a moving fiber material web, the moving fiber material web having a direction of travel and a coating surface, the coating surface carrying a first air boundary layer, said method comprising the steps of:

providing a first applicator device, said applicator device discharging a veil of coating medium onto the material web at a line of contact, the veil of coating medium carrying a second air boundary layer;

removing with at least one suction device at least a portion of at least one of said first air boundary layer and said second air boundary layer, said at least one suction device having a suction power;

sensing a dynamic air pressure at a point prior to said line of contact relative to the direction of travel of the moving material web; and controlling said suction power of said at least one suction device dependent at least in part upon said sensing step.

16. The method of claim 15, wherein said sensing step comprises directly sensing said dynamic air pressure with at least one pressure sensor disposed prior to said line of contact relative to the direction of travel of the material web.

17. The method of claim 15, wherein said sensing step comprises indirectly sensing said dynamic air pressure with at least one speed sensor, said speed sensor sensing a running speed of the material web.

18. The method of claim 15, wherein the coating medium has a solids content approximately between 5% and 80%.

19. The method of claim 18, wherein said solids content is approximately between 30% and 75%.

20. The method of claim 15, wherein the coating medium contains at least one of an inorganic and organic pigment and at least one of a synthetic binding agent and a natural binding agent.

21. The method of claim 15, wherein said applicator device applying a predetermined coating weight of the coating medium onto the material web, said coating weight being approximately between 2 $g/m^2$ and 40 $g/m^2$.

22. The method of claim 21, wherein said coating weight is approximately between 3 $g/m^2$ and 30 $g/m^2$.

23. The method of claim 15, wherein the material web has a running speed greater than 600 m/min.

24. The method of claim 23, wherein said running speed is greater than 1,000 m/min.

25. The method of claim 15, wherein the material web has a coating width configured to be coated with coating medium, the coating width being greater than 2.5 m.

26. The method of claim 25, wherein the coating width is greater than 4.0 m.

27. The method of claim 15, further comprising the step of removing at least in part said first air boundary layer with at least one scraping element, said at least one scraping element being disposed prior to said line of contact.

28. The method of claim 15, further comprising the step of stabilizing the material web by creating a partial vacuum between a backing element configured to support the material web and a material web backing surface opposite the material web coating surface.

* * * * *

UNITED STATES PATENT AND TRADEMARK OFFICE

CERTIFICATE OF CORRECTION

PATENT NO. : 6,146,690

DATED : November 14, 2000

INVENTOR(S) : Martin Kustermann

It is certified that error appears in the above-identified patent and that said Letters Patent is hereby corrected as shown below:

Column 4
line 35, delete "measure" and substitute --measured--therefor.

Column 6
line 50, delete "with" and substitute --width-- therefor.

Signed and Sealed this

Eighth Day of May, 2001

*Attest:*

Nicholas P. Godici

NICHOLAS P. GODICI

*Attesting Officer*

*Acting Director of the United States Patent and Trademark Office*